US009122218B2

(12) United States Patent
Koyama et al.

(10) Patent No.: US 9,122,218 B2
(45) Date of Patent: Sep. 1, 2015

(54) IMAGE FORMING DEVICE CAPABLE OF DETECTING ABNORMALITY IN TEMPERATURE SENSING MEMBER

(71) Applicants: Tatsuya Koyama, Toyoake (JP); Atsushi Ozawa, Nagoya (JP)

(72) Inventors: Tatsuya Koyama, Toyoake (JP); Atsushi Ozawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/165,929

(22) Filed: Jan. 28, 2014

(65) Prior Publication Data

US 2014/0212156 A1 Jul. 31, 2014

(30) Foreign Application Priority Data

Jan. 29, 2013 (JP) ..... 2013-013995
Jan. 22, 2014 (JP) ..... 2014-009327

(51) Int. Cl.
*G03G 15/20* (2006.01)
*G03G 15/00* (2006.01)

(52) U.S. Cl.
CPC ..... *G03G 15/55* (2013.01); *G03G 15/2039* (2013.01)

(58) Field of Classification Search
CPC ..... G03G 15/2039; G03G 15/205
USPC ..... 399/33, 67, 69, 70
See application file for complete search history.

(56) References Cited

FOREIGN PATENT DOCUMENTS

| | | | |
|---|---|---|---|
| JP | 04172466 A | * | 6/1992 |
| JP | 06115216 A | * | 4/1994 |
| JP | 2003245166 A | * | 9/2003 |
| JP | 2004-271905 A | | 9/2004 |

* cited by examiner

*Primary Examiner* — Erika J Villaluna
(74) *Attorney, Agent, or Firm* — Banner & Witcoff, Ltd.

(57) ABSTRACT

An image forming device including: an image forming unit; a heating body; a power supply unit; a temperature sensing member; and a controller. The image forming unit is configured to form an image on a recording sheet. The heating body is configured to heat the recording sheet on which the image is formed. The power supply unit is configured to supply power to the heating body. The temperature sensing member is configured to detect a temperature of the heating body. The controller is configured to: control the power supply unit based on the detected temperature; determine whether or not a high-power output state of the power supply unit has continued for a first duration under a print control process; and judge that the temperature sensing member is in an abnormal state when determination is made so that the high-power output state has continued for the first duration.

8 Claims, 7 Drawing Sheets

IMAGE FORMING DEVICE CAPABLE OF DETECTING ABNORMALITY IN TEMPERATURE SENSING MEMBER

CROSS REFERENCE TO RELATED APPLICATION

This application claims priority from Japanese Patent Application No. 2013-013995 filed Jan. 29, 2013 and Japanese Patent Application No. 2014-009327 filed Jan. 22, 2014. The entire content of each of these priority applications is incorporated herein by reference.

TECHNICAL FIELD

The present invention relates to an image forming device having a controller that controls a power supply unit configured to supply power to a heating body.

BACKGROUND

One image forming device known in the art includes a temperature sensing member for sensing the temperature of a heating body, and a control unit for controlling a power supply unit to supply power to the heating body based on the detection results by the temperature sensing member (Japanese Patent Application Publication No. 2004-271905, for example).

However, this conventional image forming device does not monitor the state of power output from the power supply unit. Therefore, if the state of power output from the power supply unit changes from a normal state to an abnormal state during a print control process due to a malfunction in the temperature sensing member, the control unit would not detect this abnormal state and the malfunction in the temperature sensing member.

SUMMARY

In view of the foregoing, it is an object of the present invention to provide an image forming device capable of detecting abnormality in the temperature sensing member when the state of power output from the power supply unit changes from a normal state to an abnormal state during print control.

In order to attain the above and other objects, the present invention provides an image forming device including: an image forming unit; a heating body; a power supply unit; a temperature sensing member; and a controller. The image forming unit is configured to form an image on a recording sheet. The heating body is configured to heat the recording sheet on which the image is formed. The power supply unit is configured to supply power to the heating body in a normal power output state or a high-power output state. The temperature sensing member is configured to detect a temperature of the heating body. The controller is configured to: control the power supply unit based on the detected temperature; determine whether or not the high-power output state of the power supply unit has continued for a first duration under a print control process; judge that the temperature sensing member is in a normal state when determination is made so that the high-power output state has not continued for the first duration; and judge that the power supply unit is in an abnormal state when determination is made so that the high-power output state has continued for the first duration.

BRIEF DESCRIPTION OF THE DRAWINGS

The particular features and advantages of the invention as well as other objects will become apparent from the following description taken in connection with the accompanying drawings, in which.

DETAILED DESCRIPTION

<Overall Structure of a Laser Printer>

Figure 1:
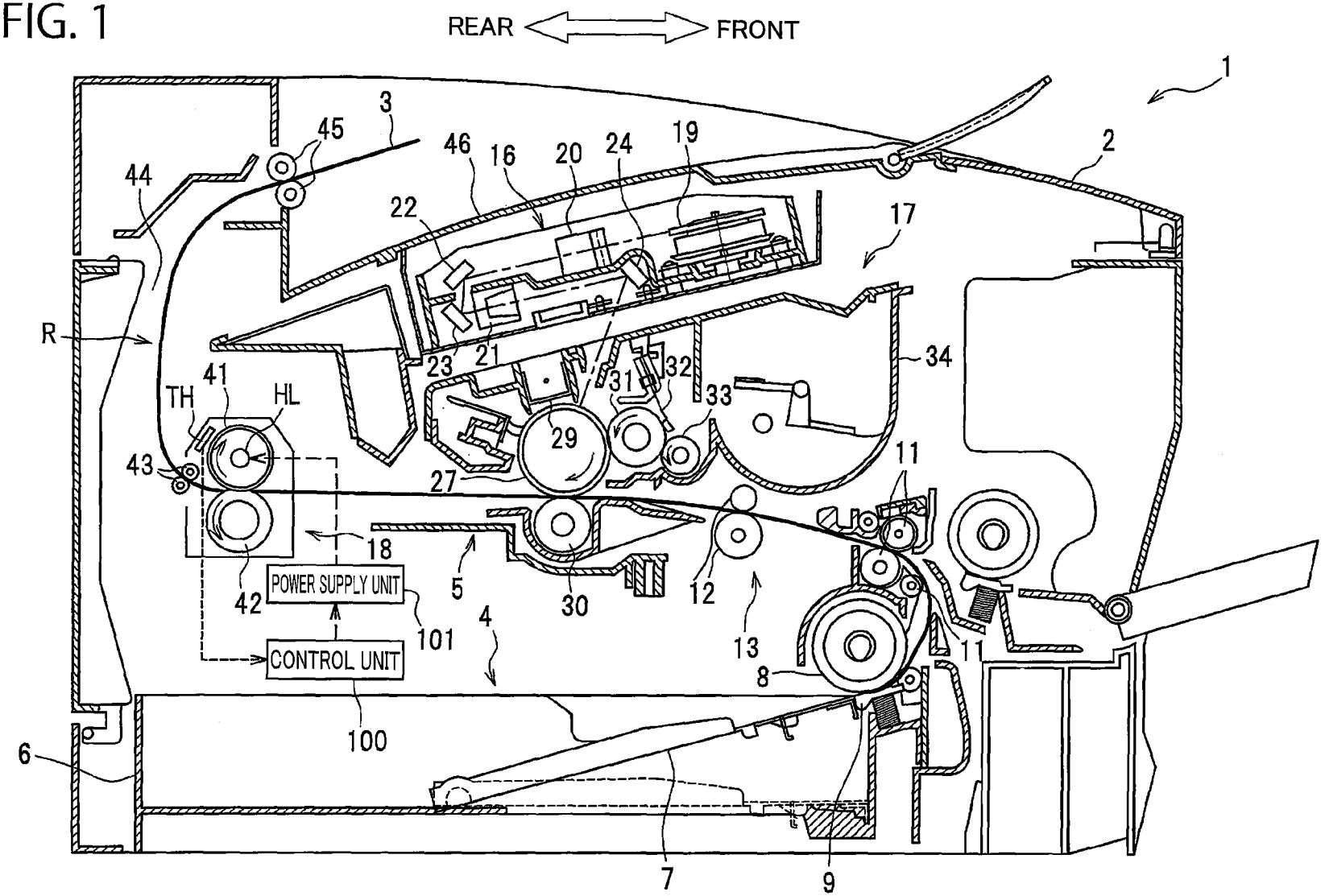
FIG. 1 is a cross-sectional side view of a laser printer according to an embodiment of the present invention.

Next, a preferred embodiment of the present invention will be described while referring to the accompanying drawings wherein like parts and components are designated by the same reference numerals to avoid duplicating description. As shown in FIG. 1, a laser printer 1 is provided with a device body 2, a feeding unit 4 for feeding sheets 3 of paper to be printed, an image-forming unit 5 for forming images on sheets 3 supplied by the feeding unit 4, and a fixing unit 18 for fixing images on the sheets 3.

The feeding unit 4 includes a paper tray 6 that is removably mounted in the bottom section of the device body 2, and a paper-pressing plate 7 disposed in the paper tray 6. Sheets 3 of paper are stacked in the paper tray 6 on top of the paper-pressing plate 7. The feeding unit 4 further includes a pickup roller 8 and a feeding pad 9 disposed above the front end of the paper tray 6, paper dust rollers 11 disposed downstream of the pickup roller 8 in the conveying direction of the sheets 3, and registration rollers 12 disposed downstream of the paper dust rollers 11.

With the feeding unit 4 having this configuration, the paper-pressing plate 7 functions to urge the front end of the sheets 3 accommodated in the paper tray 6 toward the pickup roller 8. The pickup roller 8 and feeding pad 9 cooperate to feed the sheets 3 one at a time to the rollers 11 and 12, and the rollers 11 and 12 convey the sheets 3 to the image-forming unit 5.

The image-forming unit 5 includes a scanning unit 16, and a process cartridge 17.

The scanning unit 16 is disposed in the top section of the device body 2. The scanning unit 16 includes a laser light-emitting unit (not shown), a polygon mirror 19 that is driven to rotate, lenses 20 and 21, and reflecting mirrors 22, 23, and 24. The laser light-emitting unit of the scanning unit 16 emits a laser beam that follows a path indicated by the chain line in FIG. 1 and is irradiated onto the surface of a photosensitive drum 27 in the process cartridge 17 described next through a high-speed scan.

The process cartridge 17 is detachably mounted in the device body 2 at a position below the scanning unit 16. The process cartridge 17 includes the photosensitive drum 27, a charger 29, a transfer roller 30, a developing roller 31, a thickness-regulating blade 32, a supply roller 33, and a toner hopper 34.

In the process cartridge 17 having this construction, the charger 29 applies a charge to the surface of the photosensitive drum 27, and the scanning unit 16 subsequently irradiates a laser beam onto the surface to form an electrostatic latent image thereon. The supply roller 33 supplies toner from the tonner hopper 34 onto the developing roller 31, and the developing roller 31 supplies the toner in turn onto the latent image to form a toner image on the surface of the photosensitive drum 27. The toner image is subsequently transferred onto a sheet 3 as the sheet 3 is conveyed between the photosensitive drum 27 and transfer roller 30.

The fixing unit 18 includes a heating roller 41, a halogen lamp HL, a pressure roller 42, and a thermistor TH.

The heating roller 41 is a cylindrical member functioning to apply heat to the sheets 3. The halogen lamp HL is disposed inside the heating roller 41 for generating heat that is transferred to the sheets 3 via the heating roller 41. A power supply unit 101 is provided in the device body 2 for supplying power to the halogen lamp HL, and the halogen lamp HL generates heat upon receiving this power.

The pressure roller 42 is disposed in confrontation with the heating roller 41 and applies pressure to the same. With this arrangement, a nip part is formed between the heating roller 41 and pressure roller 42.

The thermistor TH is a non-contact sensor that detects the temperature around the heating roller 41 (hereinafter called the "ambient temperature"). Thus, the thermistor TH is separated from the surface of the heating roller 41.

In the fixing unit 18 having this construction, the heating roller 41 is heated by the halogen lamp HL so that a toner image transferred onto a sheet 3 is thermally fixed to the sheet 3 as the sheet 3 passes between the heating roller 41 and pressure roller 42. Following the fixing operation in the fixing unit 18, conveying rollers 43 disposed downstream of the fixing unit 18 convey the sheet 3 along a discharge path 44. Discharge rollers 45 disposed at the end of the discharge path 44 discharge the sheet 3 from the discharge path 44 onto a discharge tray 46.

The laser printer 1 has an S-shaped conveying path R that extends from the paper tray 6, through the image-forming unit 5 and fixing unit 18, and to the outside of the device body 2. The paper-pressing plate 7, pickup roller 8, feeding pad 9, paper dust roller 11, registration rollers 12, photosensitive drum 27, transfer roller 30, heating roller 41, pressure roller 42, conveying rollers 43, discharge rollers 45, and the like constitute a conveying mechanism 13 that functions to covey sheets 3 along the conveying path R.

<Control Unit>

Next, a control unit 100 will be described. The control unit 100 is configured of a CPU, RAM, ROM, and input/output circuit. The control unit 100 performs computations for controlling the power supply unit 101, conveying mechanism 13, and the like based on input received from the thermistor TH described above, the content of print commands, programs and data stored in ROM, and the like.

Figure 4:
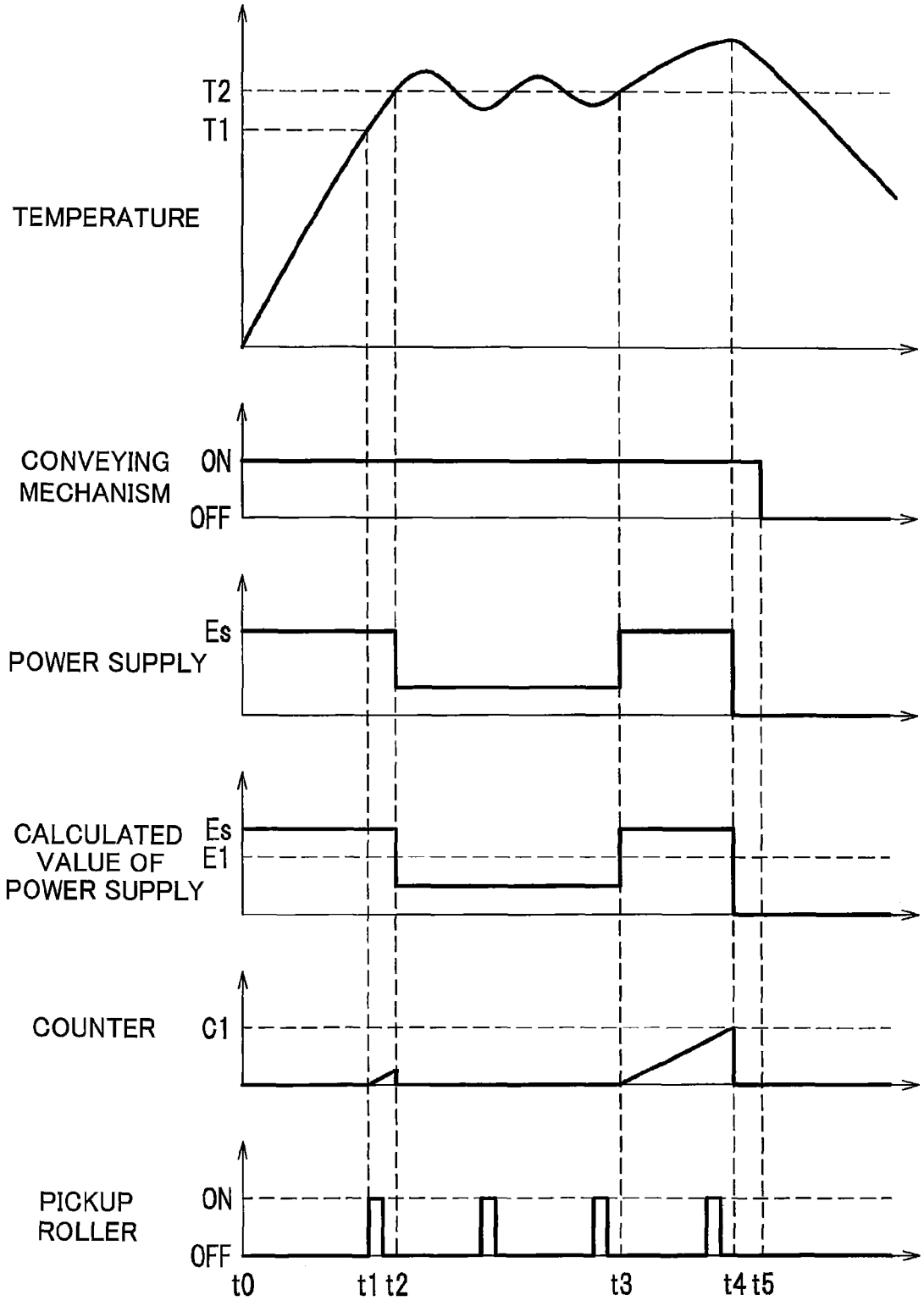
FIG. 4 is a time chart illustrating changes of various parameters after a print command is received during the sleep mode.

The control unit 100 is configured to control the power per unit time outputted from the power supply unit 101 (the duty cycle of the power supply unit 101) to the halogen lamp HL based on the temperature detected by the thermistor TH according to a well-known method. As shown in FIG. 4, the control unit 100 according to the preferred embodiment controls the power supply per unit time outputted from the power supply unit 101 to the halogen lamp HL to be an initial value Es (a duty ratio of 100%, for example) that is greater than a prescribed value E1 during a warm-up operation performed prior to the start of print control (between timings t0 and t1). The control unit 100 continues to maintain the power supply at the initial value Es after print control has started until the temperature detected by the thermistor TH reaches a fixing temperature T2 (a target temperature deemed suited to the fixing operation; between timing t1 and t2). Once the temperature detected by the thermistor TH reaches the fixing temperature T2, the control unit 100 controls the power supply at a value lower than the initial value Es based on the detected temperature in order to maintain the detected temperature at the fixing temperature T2. For simplification, the graphs in FIG. 4 omit any fluctuations in the power supply and the calculated values of this power supply while the control unit 100 controls the power supply based on the detected temperature, i.e., during normal print control (between timings t2 and t3), but show these values as being constant.

In the preferred embodiment, the control unit 100 possesses a function for determining during print control whether the power supply unit 101 has been in a continuous high-power output state for a first duration. Here, a high-power output state denotes that a calculated value of the power supply per unit time outputted from the power supply unit 101 to the halogen lamp HL exceeds the prescribed value E1. The calculated value of the power supply is a value that the control unit 100 computes based on the detected temperature of the thermistor TH and the fixing temperature T2 described above. In the preferred embodiment, the control unit 100 is configured to output the calculated value itself to the power supply unit 101 as a command value.

While a high-power output state has not continued for the first duration, the control unit 100 determines that the thermistor TH is operating normally and detecting the correct temperature, and controls the power supply unit 101 to continue supplying power based on the temperature detected by the thermistor TH. If the high-power output state has continued for the first duration, the control unit 100 determines that the thermistor TH is operating abnormally and detecting the wrong temperature, and halts power supply from the power supply unit 101 independently of the temperature detected by the thermistor TH. Through this control process, the control unit 100 can prevent the power supply unit 101 from supplying excessive power to the halogen lamp HL during print control when the state of power output from the power supply unit 101 is abnormal, i.e., differs from the normal state (when the high-power output state has continued for the first duration in this example).

When the high-power output state has continued for the first duration, indicating that the power supply unit 101 is in an abnormal state, the control unit 100 controls the conveying mechanism 13 to discharge any sheets 3 remaining on the conveying path R from the device body 2. Specifically, the control device 100 lowers the paper-pressing plate 7 and continues driving the conveying mechanism 13 for an amount of time necessary for a sheet 3 disposed on the farthest upstream end of the conveying path R (a sheet 3 whose leading edge is interposed between the pickup roller 8 and feeding pad 9) to be discharged onto the discharge tray 46. Note that the drive time for the conveying mechanism 13 following a determination that the high-power output state has continued for the first duration can be set to be a suitable value found through experimentation, simulations, and the like.

By driving the conveying mechanism 13 for the prescribed time required to discharge sheets 3 from the conveying path R when the control unit 100 determines that the power supply unit 101 is in an abnormal state, the laser printer 1 according to the preferred embodiment does not require the user to extract the sheets 3 from the conveying path R following an abnormality determination as would be necessary if the conveying mechanism were halted simultaneously with the power supply, for example.

Further, after halting the power supply due to a high-power output state that has continued for the first duration, the control unit 100 is configured to prohibit a new print control operation from being started during a second duration after the power supply was halted. This control method allows the halogen lamp HL and the heating roller 41 to cool during the second duration after the abnormality occurred (after the power supply was halted). Accordingly, the heating roller 41 and the like can be returned to a suitable temperature state for the next print control process.

Figure 2:
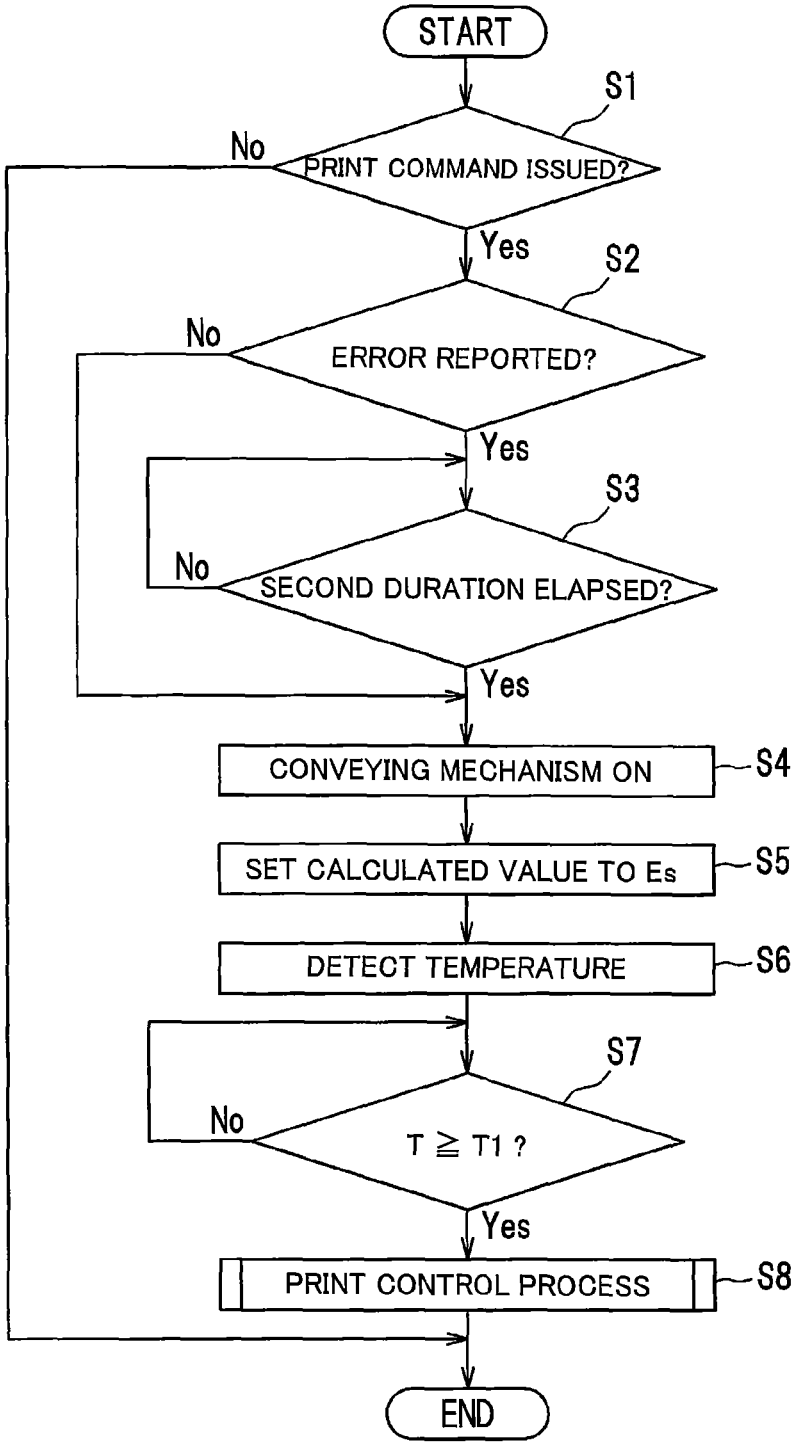
FIG. 2 is a flowchart illustrating steps in operations of a control unit during a sleep mode and a ready mode.
Figure 3:
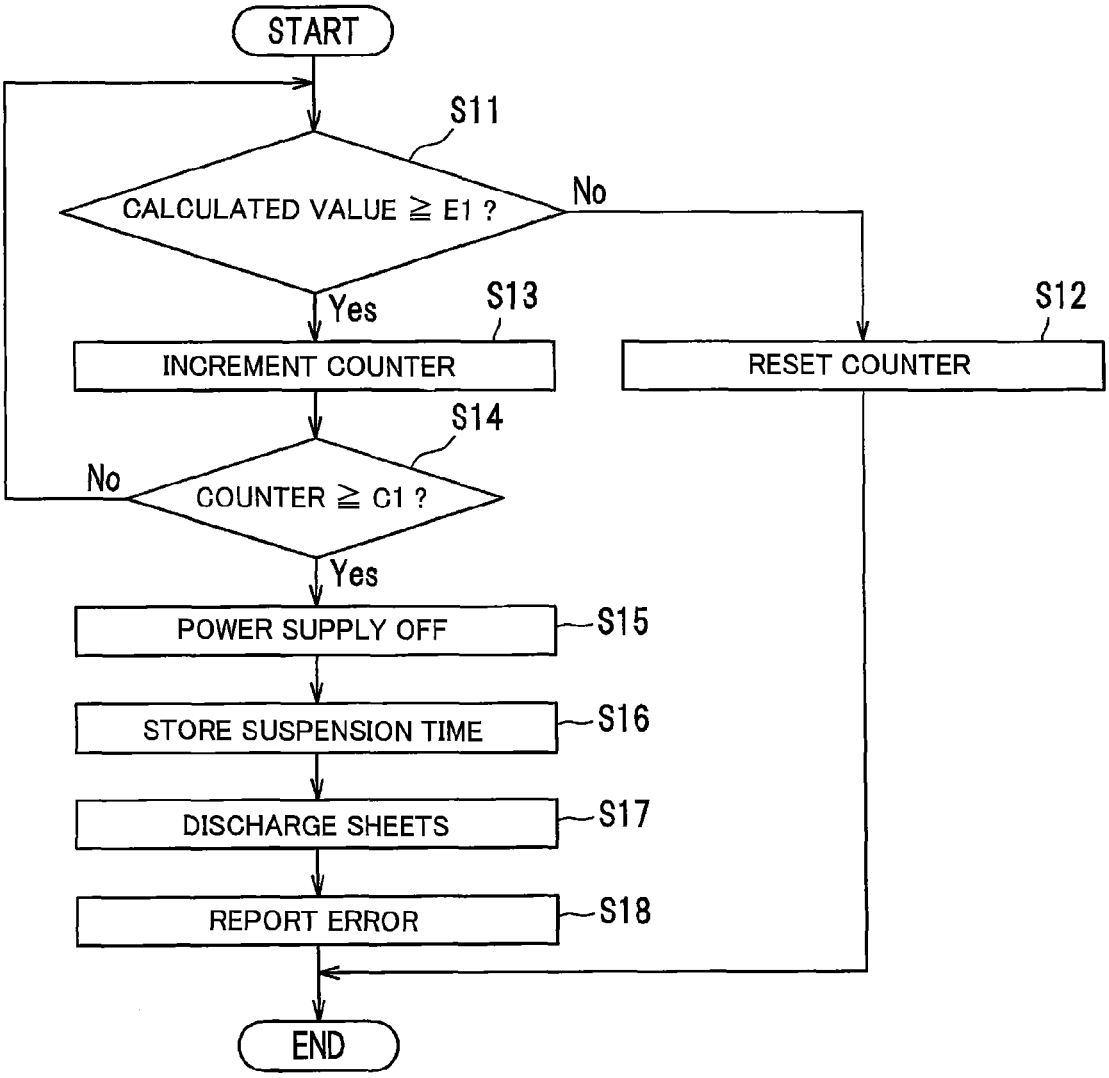
FIG. 3 is a flowchart illustrating steps in a control process executed in parallel with a print control process.

More specifically, the control unit 100 continuously executes the process according to the flowchart in FIG. 2 during the sleep mode and ready mode, and executes the process according to the flowchart shown in FIG. 3 in parallel with a print control process when print control is initiated.

In S1 of FIG. 2, the control unit 100 first determines whether a print command has been issued. If a print command has been issued (S1: YES), in S2 the control unit 100 determines whether an error was previously reported. The control unit 100 may make this determination based on an error flag that is set when an error is reported, for example. In the preferred embodiment, the control unit 100 determines whether a power supply suspension time described later has been stored in a storage unit (not shown).

If the control unit 100 determines in S2 that an error was reported previously (S2: YES), then in S3 the control unit 100 determines whether the second duration has elapsed since the power supply unit 101 was turned off following the error determination (the time stored in S16 described later). If the second duration has elapsed (S3: YES) or if an error was not previously reported (S2: NO), in S4 the control unit 100 controls the members of the conveying mechanism 13 excluding the paper-pressing plate 7 to execute an idling operation known in the art. The control unit 100 is also configured to reset the power supply suspension time stored in the storage unit when determining in S3 that the second duration has elapsed.

In S5 the control unit 100 sets the calculated value of the power supply to the initial value Es, which is greater than the prescribed value E1. The control unit 100 outputs this initial value Es to the power supply unit 101 as a command value. In S6 the control unit 100 acquires the temperature detected by the thermistor TH and in S7 determines whether the detected temperature T acquired in S6 is greater than or equal to a prescribed printing start temperature T1.

The printing start temperature T1 in the preferred embodiment is lower than the fixing temperature T2 and is set such that the temperature at the nip part between the heating roller 41 and pressure roller 42 will rise at least to the fixing temperature T2 during the time required to convey a sheet 3 from the paper tray 6 to the nip part. The printing start temperature T1 is set to a suitable value through experimentation, simulation, and the like.

If the detected temperature T is greater than or equal to the printing start temperature T1 (S7: YES), in S8 the control unit 100 initiates a print control process known in the art and simultaneously begins the control process shown in FIG. 3. Note that in S8 the control unit 100 first controls the pickup roller 8 of the conveying mechanism 13 to begin conveying a sheet 3, and subsequently controls the conveying mechanism 13 and power supply unit 101 according to a well-known process until the prescribed number of pages have been printed based on the print command.

After completing the process in S8, or if a print command has not been issued (S1: NO), the control unit 100 ends the current control process.

In S11 at the beginning of the control process in FIG. 3, the control unit 100 determines whether the calculated value of the power supply exceeds the prescribed value E1. If the calculated value of the power supply does exceed the prescribed value E1 (S11: YES), in S13 the control unit 100 increments a counter.

In S14 the control unit 100 determines whether the counter exceeds a first threshold value C1. The first threshold value C1 signifies whether the calculated value of the power supply has remained in a high-power output state greater than or equal to the prescribed value E1 for the first duration. If the control unit 100 determines that the counter is less than the first threshold value C1 (S14: NO), the control unit 100 determines that the thermistor TH is operating normally and returns to S11. In other words, since the control unit 100 determines that the thermistor TH is operating normally when the counter is less than the first threshold value C1 (S14: NO), the control unit 100 continues to perform the print control process (to supply power from the power supply unit 101) in parallel with the process in FIG. 3.

However, if the control unit 100 determines in S14 that the counter is greater than or equal to the first threshold value C1 (S14: YES), in S15 the control unit 100 determines that the thermistor TH is operating abnormally and suspends the power supply from the power supply unit 101. At this time, the control unit 100 ends the print control process being performed parallel with this control process. In S16 the control unit 100 stores the time at which power supply was suspended (hereinafter called the "power supply suspension time") in a storage unit (not shown).

In S17 the control unit 100 discharges any remaining sheets 3 in the conveying path R onto the discharge tray 46 by driving the conveying mechanism 13 for a prescribed timing before halting the same. In S18 the control unit 100 reports an error to the user through reporting means, such as a warning lamp, buzzer, or the like (not shown). Subsequently, the control unit 100 ends the current control process. In addition, when the control unit 100 determines in S11 that the calculated value of the power supply is less than the prescribed value E1 (S11: NO), in S12 the control unit 100 resets the counter and ends the current control process.

Next, the operations of the control unit 100 performed when a print command is received during the sleep mode will be described with reference to FIG. 4 to illustrate an example of this control process.

As shown in FIG. 4, upon receiving a print command in the sleep mode, the control unit 100 sets the calculated value of the power supply to the large initial value Es. By doing so, the control unit 100 rapidly heats the heating roller 41 so that the temperature of the heating roller 41 rises along a steep slope. Once the temperature of the heating roller 41 reaches the printing start temperature T1 (at timing t1), the control unit 100 initiates print control by operating the pickup roller 8 and paper-pressing plate 7 to begin conveying a sheet 3.

After starting the print control process, the control unit 100 continues to maintain the calculated value of the power supply at the initial value Es until the temperature of the heating roller 41 reaches the fixing temperature T2. The time at which the calculated value is maintained at the initial value Es is measured by the counter. When the temperature of the heating roller 41 reaches the fixing temperature T2 (at timing t2), the control unit 100 resets the counter and lowers the calculated value of the power supply to a value based on the temperature of the heating roller 41 (the detected temperature). Thereafter, the control unit 100 executes normal print control (between timings t2 and t3) while modifying the calculated value as needed based on the detected temperature.

When the calculated value of the power supply exceeds the prescribed value E1 during the print control process (at timing t3), the control unit 100 starts measuring time with the counter. Once the counter is greater than or equal to the first threshold value C1 (at timing t4), the control unit 100 sets the calculated value of the power supply to "0", halting power supply from the power supply unit 101.

Thus, when the state of power supply changes from the normal state to an abnormal state (a state in which a high-power output condition continues for the first duration) during a print control process, the control unit 100 shuts off the power supply unit 101. This action prevents the power supply unit 101 from supplying excessive power to the halogen lamp HL.

After shutting off the power supply, the control unit 100 discharges any sheets 3 remaining on the conveying path R onto the discharge tray 46 by driving the conveying mechanism 13 for a prescribed time before halting the same (between timings t4 and t5). This operation eliminates the need for the user to extract sheets 3 remaining in the device body 2 after an abnormality has occurred.

While the invention has been described in detail with reference to specific embodiments thereof, it would be apparent to those skilled in the art that many modifications and variations may be made therein without departing from the spirit of the invention, the scope of which is defined by the attached claims.

In the preferred embodiment, the control unit 100 calculates a value of power supply based on the temperature detected by the thermistor TH and the fixing temperature T2, and outputs this calculated value unchanged to the power supply unit 101. However, the control unit 100 may set an upper limit for the calculated value during abnormal determinations and may output a power supply amount equivalent to this upper limit as the command value when the calculated value is greater than or equal to the upper limit. That is, the control unit 100 may perform a control process based on the flowchart shown in FIG. 5.

Figure 5:
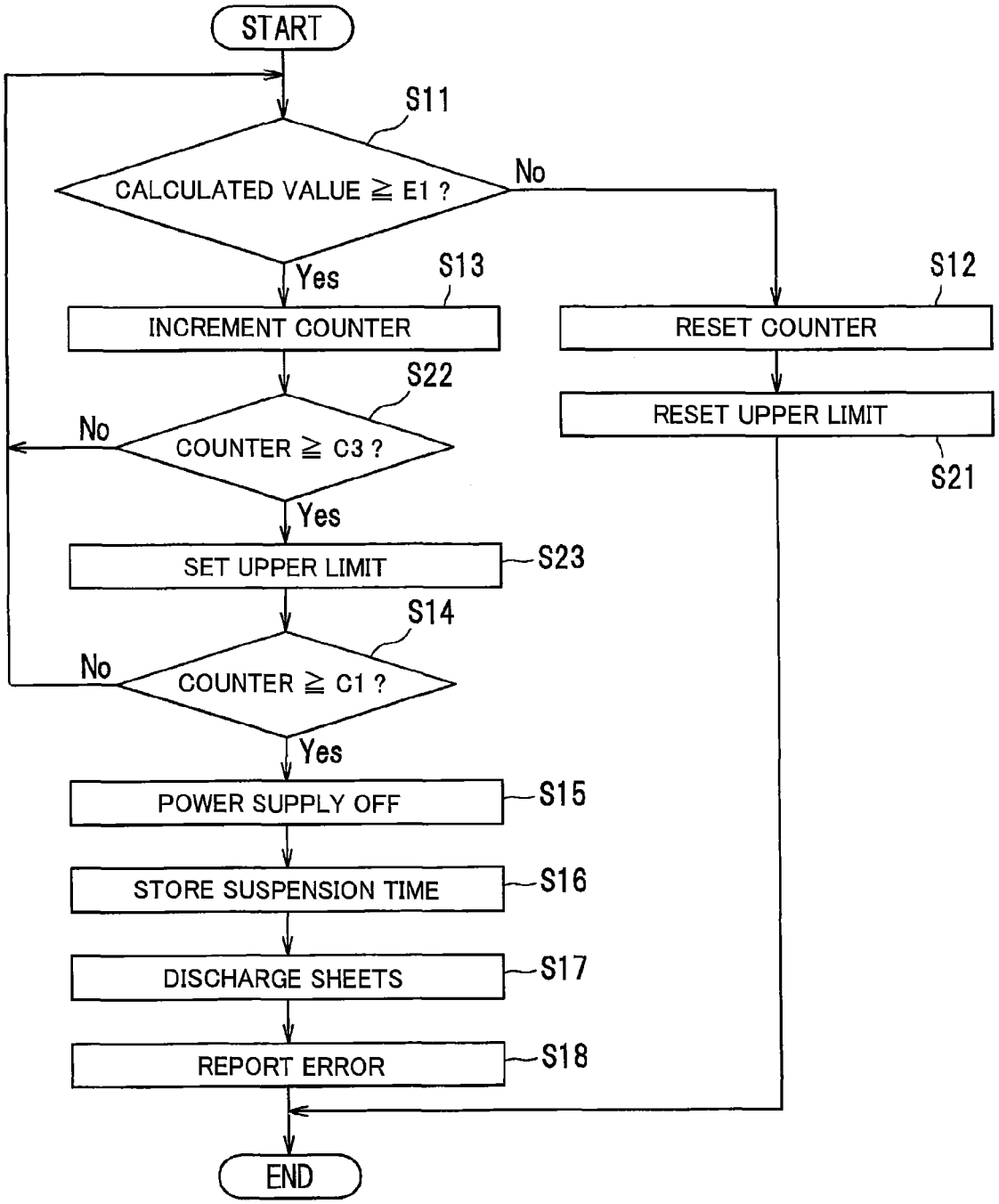
FIG. 5 is a flowchart illustrating steps in operations of a control unit according to a modification to the embodiment.

The flowchart in FIG. 5 includes all steps S11-S18 from the flowchart in FIG. 3, but adds new steps S22 and S23 between steps S13 and S14 and adds new step S21 after step S12. In S22 the control unit 100 determines whether a high-power output state has continued for a third duration, shorter than the first duration, by determining whether the counter is greater than or equal to a third threshold value C3 (where C3<C1).

If the control unit 100 determines that the counter is greater than or equal to the third threshold value C3 (S22: YES), in S23 the control unit 100 sets the upper limit for the power supply outputted from the power supply unit 101 to a prescribed value E2, smaller than the prescribed value E1. Before the upper limit is set to the prescribed value E2 in S23, the upper limit can be initialized to a value higher than the prescribed value E1, such as 100%. In S21 the control unit 100 resets the upper limit set in S23 (to its initial value).

Figure 6:
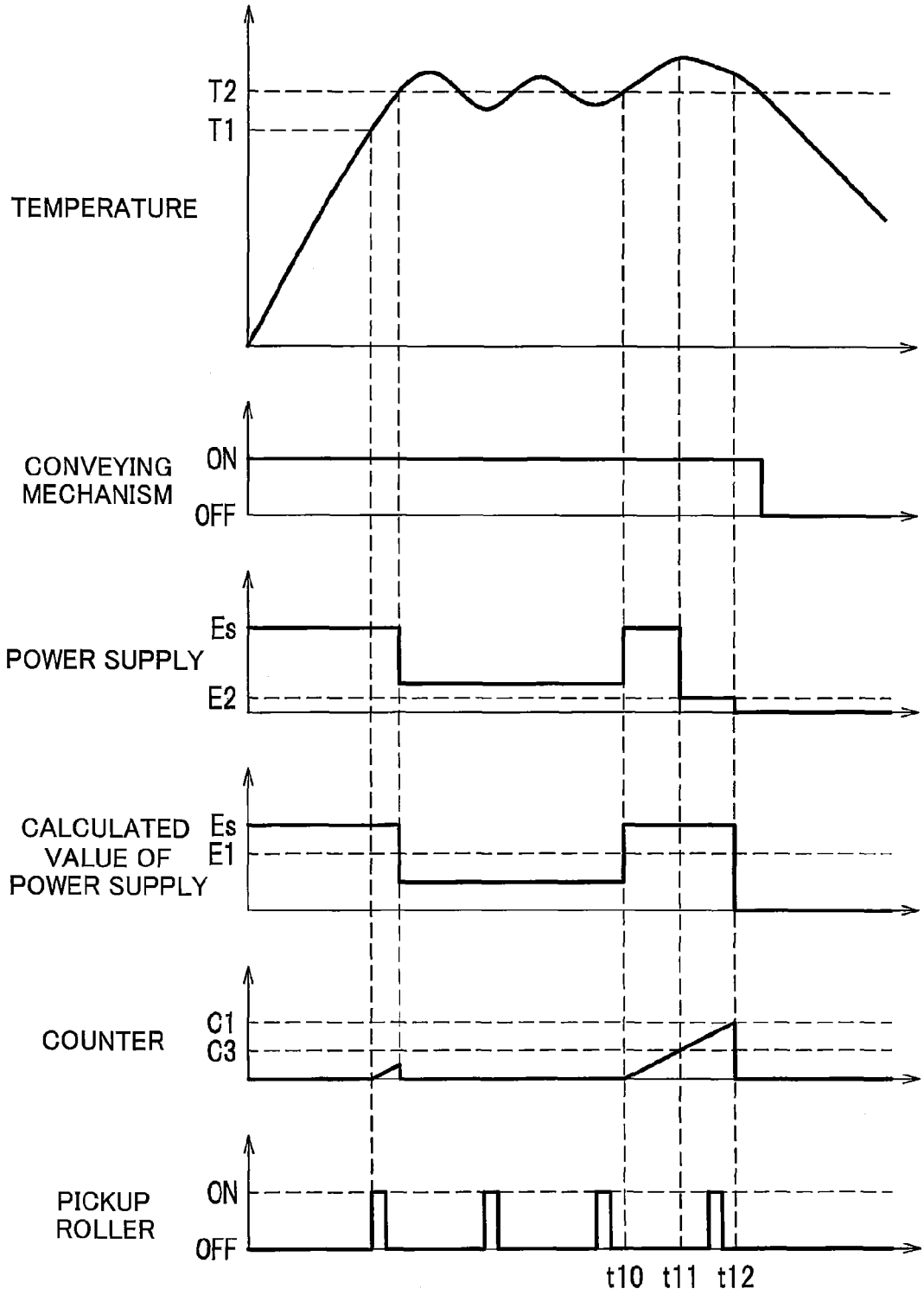
FIG. 6 is a time chart illustrating operations of the control unit in which an upper limit is set during abnormal determinations.

Thus, when the counter exceeds the third threshold value C3 during abnormality determinations following the timing t10 (and specifically timing t11), the control unit 100 restricts the power supply value outputted to the power supply unit 101 as the command value to the upper limit (prescribed value E2), as shown in FIG. 6. This process prevents the power supply unit 101 from supplying excessive power to the halogen lamp HL during abnormality determinations (between timings t10 and t12). Accordingly, the control unit 100 can prevent the temperature of the heating roller 41 from rising too high prior to halting the power supply (at timing t12).

Note, abnormality determinations can be implemented as described in the preferred embodiment by monitoring the calculated value of the power supply prior to restricting the value to the upper limit (prescribed value E2).

Figure 7:
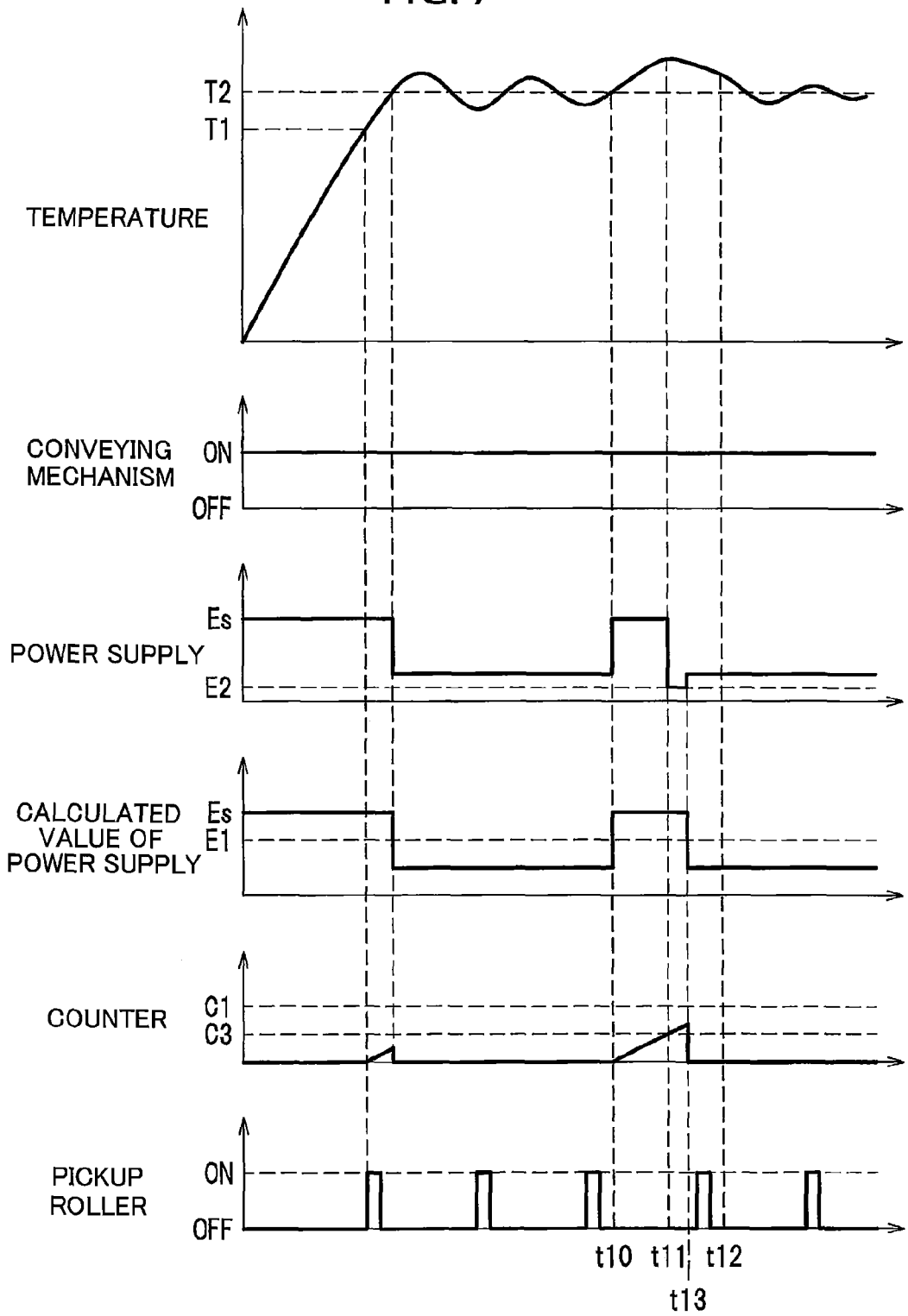
FIG. 7 is a time chart illustrating operations of the control unit in which power supply returns to normal after setting the upper limit.

As shown in FIG. 7, after setting the upper limit at the timing t11, the control unit 100 returns the upper limit to its initial value once the calculated value of the power supply has dropped below the prescribed value E1 (at timing t13). Through this process, when the calculated value of the power supply drops below the prescribed value E1, i.e., after the thermistor TH has returned to be able to detect the correct temperature, the control unit 100 no longer restricts output of the power supply unit 101 using the upper limit (prescribed value E2). Hence, the control unit 100 can continue proper print control thereafter.

In the preferred embodiment described above, the control unit 100 determines whether the thermistor TH is in an abnormal state by detecting during print control whether high-power output state has continued for the first duration, where the high-power output state is a state in which the calculated value of the power supply is greater than or equal to a prescribed value. However, the control unit 100 may also determine that the thermistor TH is abnormal by detecting whether a low-power output state has continued for the first duration, where a low-power output state is the state in which the calculated value of the power supply is less than or equal to a prescribed threshold value. In other words, the control unit may be configured to determine whether the output state of the power supply unit has remained outside a particular range for the first duration, indicating that the calculated value of the power supply has remained outside a prescribed range, and may judge that the thermistor TH is operating normally when the output state has not been outside the prescribed range continuously for the first duration and that the thermistor TH is operating abnormally when the output state has remained outside the prescribed range for the first duration.

Here, the "prescribed range" is a range of power supply values that can be outputted during print control while the thermistor TH is in a normal state, and may be set to a suitable range through experimentation and simulations.

While the present invention is applied to the laser printer 1 in the preferred embodiment, the present invention may be applied to other types of image forming devices, including copy machines and multifunction peripherals.

While the heating roller 41 and the halogen lamp HL serve as examples of heating bodies in the preferred embodiment, the heating bodies may be configured to possess heating resistors or induction heaters, for example. Although an induction heater itself does not produce heat, its electromagnetic-induction heating system can generate heat in rollers or metal belts.

While recording sheets in the embodiment are described as sheets 3 of paper, which may include normal paper, heavy paper, postcards, and the like, the present invention may be applied to transparencies or other types of recording sheets as well.

What is claimed is:

1. An image forming device comprising:

an image forming unit configured to form an image on a recording sheet;

a heating body configured to heat the recording sheet on which the image is formed;

a power supply unit configured to supply power to the heating body in a normal-power output state or a high-power output state;

a temperature sensing member configured to detect a temperature of the heating body; and a controller configured to:

control the power supply unit based on the detected temperature;

determine whether or not the high-power output state of the power supply unit has continued for a first duration under a print control process; and judge that the temperature sensing member is in a normal state when a determination is made that the high-power output state has not continued for the first duration, and judge that the temperature sensing member is in an abnormal state when determination is made that the high-power output state has continued for the first duration, wherein the controller is further configured to:

calculate an amount of power supplied to the heating body from the power supply unit based on the detected temperature;

determine that the power supply unit is in the high-power output state when the calculated amount of power is equal to or greater than an upper limit of a prescribed allowable range; and determine that the power supply unit is in the normal-power output state when the calculated amount of power is within the prescribed allowable range.

2. The image forming device according to claim 1, wherein the controller is configured to:

control the power supply unit to continue power supply to the heating body when a judgment is made that the temperature sensing member is in the normal state; and control the power supply unit to halt the power supply to the heating body when a judgment is made that the temperature sensing member is in the abnormal state.

3. The image forming device according to claim 2, further comprising:

a tray configured to accommodate the recording sheet;

a conveying path that extends from the tray, through the image forming unit and the heating body, and to an outside of a device body; and a conveying mechanism configured to convey the recording sheet on the conveying path, wherein the controller is further configured to control the conveying mechanism to discharge any recording sheets remaining on the conveying path to the outside of the device body when a judgment is made that the temperature sensing member is in the abnormal state.

4. The image forming device according to claim 2, wherein the controller is further configured to prohibit a new print control process from being started during a second duration after the power supply was halted.

5. The image forming device according to claim 2, wherein the controller is further configured to:

determine whether or not the high-power output state has continued for a third duration shorter than the first duration; and set an upper limit of power supplied to the heat body from the power supply unit when a determination is made that the high-power output state has continued for the third duration, the upper limit of power being smaller than the upper limit of the prescribed allowable range.

6. The image forming device according to claim 5, wherein the controller is further configured to reset the upper limit of power when the calculated amount of power becomes smaller than the upper limit of the prescribed allowable range after the upper limit of power was set.

7. The image forming device according to claim 5, wherein the controller is further configured to:

set a first upper limit of power supplied to the heat body from the power supply unit when the print control process is started, the first upper limit of power is greater than the upper limit of the prescribed allowable range; and change the first upper limit of power into a second upper limit of power smaller than the upper limit of the prescribed allowable range.

8. The image forming device according to claim 7, wherein the controller is further configured to reset the second upper limit of power to the first upper limit of power when the calculated amount of power becomes smaller than the upper limit of the prescribed allowable range after the first upper limit of power was changed into the second upper limit of power.

* * * * *